United States Patent [19]

Schlink

[11] Patent Number: 4,527,489

[45] Date of Patent: Jul. 9, 1985

[54] RAILROAD TANK CAR SKID CONSTRUCTION

[75] Inventor: Lawrence J. Schlink, Highland, Ind.

[73] Assignee: Union Tank Car Company, East Chicago, Ind.

[21] Appl. No.: 490,792

[22] Filed: May 2, 1983

[51] Int. Cl.[3] ..... B61D 5/00

[52] U.S. Cl. ..... 105/358; 105/362; 251/144; 137/377; 220/85 P

[58] Field of Search ..... 105/358, 360, 362, 408; 137/377, 350; 220/85 P; 251/144; 293/102, 120

[56] References Cited

U.S. PATENT DOCUMENTS

| | | | |
|---|---|---|---|
| 1,710,175 | 4/1929 | Mascuch | 293/120 |
| 1,988,308 | 1/1935 | Folmsbee | 105/362 |
| 3,308,769 | 3/1967 | Halcomb et al. | 105/362 |
| 3,591,131 | 7/1971 | Carlson | 251/144 |
| 4,056,117 | 11/1977 | Deeks | 137/68 R |
| 4,184,663 | 1/1980 | Rollins et al. | 251/144 |
| 4,220,097 | 9/1980 | Wempe et al. | 105/360 |
| 4,394,002 | 7/1983 | Polley | 251/144 |

OTHER PUBLICATIONS

Midland Mfg. Corp., Drawing No. B-376.

Pullman Leasing Co., Drawing No. SK-PLC-7-7-8-1-B.

*Primary Examiner*—Randolph A. Reese

*Assistant Examiner*—Dennis C. Rodgers

*Attorney, Agent, or Firm*—Dressler, Goldsmith, Shore, Sutker & Milnamow

[57] ABSTRACT

A skid arrangement to protect an appurtenance which extends from the bottom of a railroad tank car. The skid arrangement includes a ramped box-like frame structure which is defined by longitudinal side plates and transverse end plates and diaphragm plates. The upper edges of the end plates and diaphragm plates are welded to a reinforcing pad. A pair of wood blocks are positioned within and secured to the frame structure in contact with the reinforcing pad by stud members extending therethrough and through the side plates. Impact forces which are applied to the skid arrangement are directed by the stud members into the wood blocks and in turn are directed into the reinforcing pad and uniformly distributed over a substantial length of the body of the tank car.

16 Claims, 8 Drawing Figures

Fig. 1.
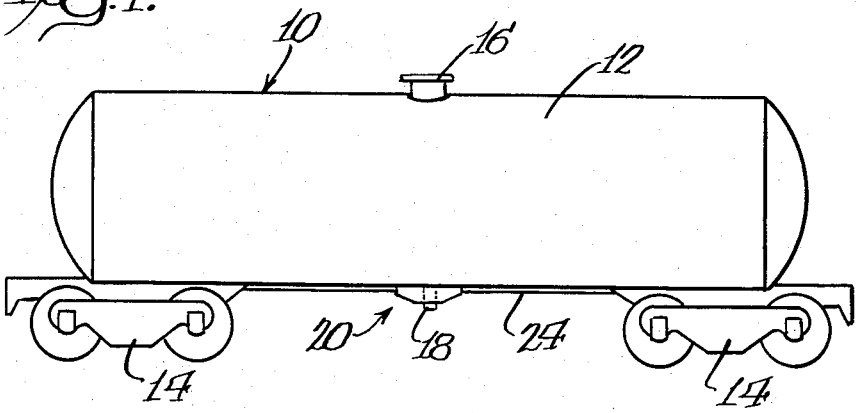
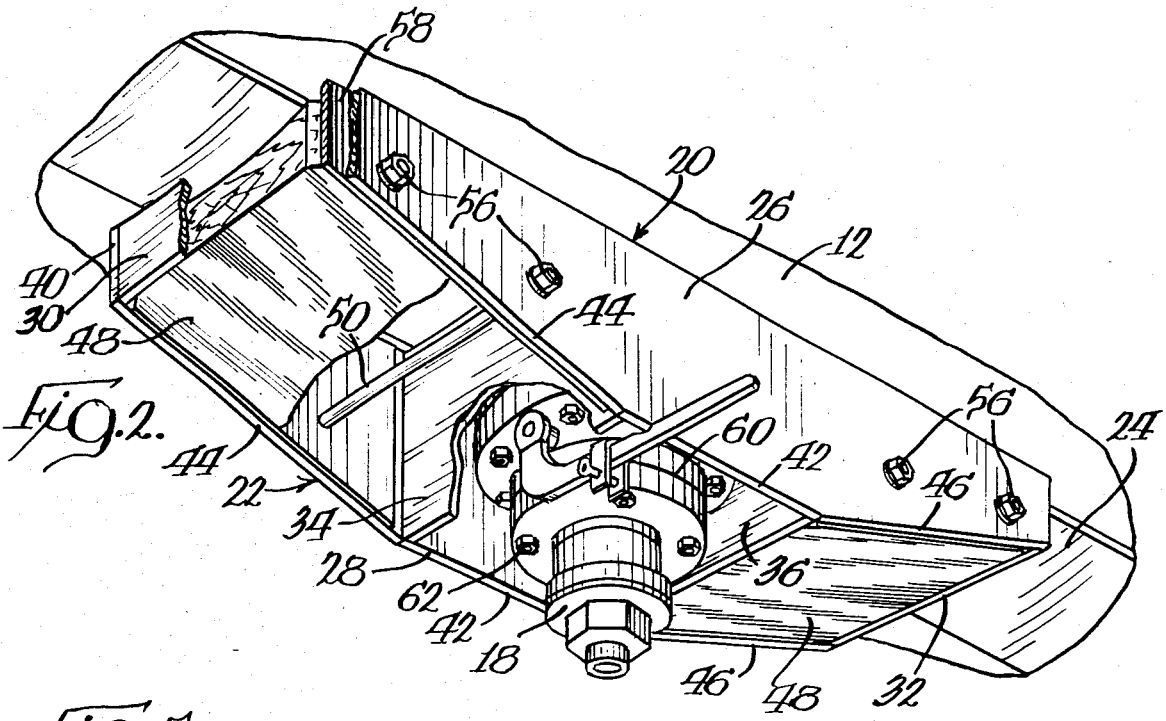
Fig. 2.
Fig. 5.
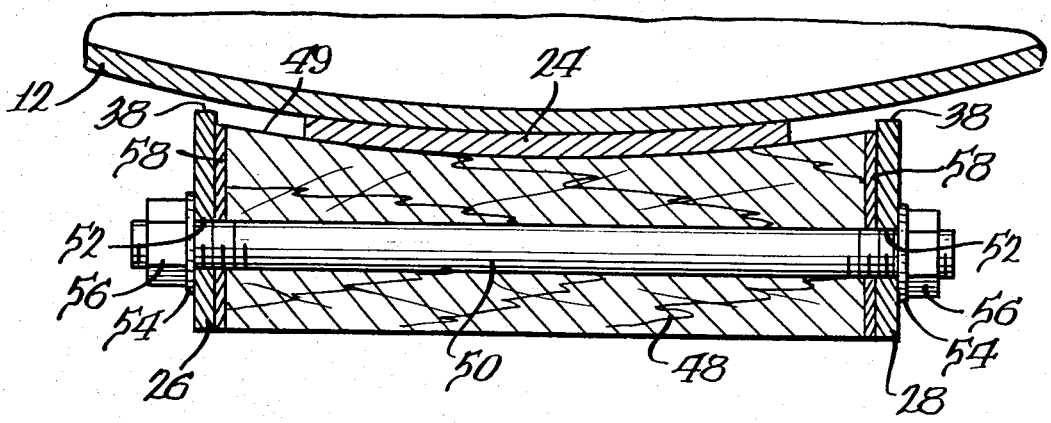

RAILROAD TANK CAR SKID CONSTRUCTION

BACKGROUND OF THE INVENTION

The present invention is directed to improvements in the construction of skids to protect the appurtenances which extend from the bottom of a railroad tank car.

In recent years particular attention has been directed to the problem of protecting the downwardly projecting appurtenances, such as bottom outlet valves, of railway tank cars and thereby preventing the loss of lading therefrom in the instance of a derailment. Current Association of American Railroads (AAR) and Department of Transportation (DOT) railway tank car regulations for stub sill cars require that various projections extending below the tank bottom must be protected.

Various valve designs and skid designs and combinations thereof have been proposed to solve this problem. An example of such a design is disclosed in U.S. Pat. No. 4,184,663. The outlet valve assembly disclosed in this patent has a shear plane such that if the valve assembly is impacted the bottom portion of the valve is sheared off while the closure portion remains intact preventing the lading from exiting therefrom. A skid arrangement is provided around the valve assembly to protect the closure portion of the valve assembly by directing impact forces against the bottom of the tank car into the body of the tank car.

The present invention is specifically directed to providing an improved skid arrangement which more uniformly distributes the impact forces into the body portion of the tank car and yet is relatively light in weight and structurally reliable.

SUMMARY OF THE INVENTION

The skid arrangement in accordance with the present invention includes a ramped frame structure which is secured to a reinforcing pad attached along the length of the body of the tank car. The frame structure is a box-like structure which is defined by longitudinal side plates and transverse end plates and diaphragm plates. The upper edges of the end plates and diaphragm plates are welded to the reinforcing pad, while the upper edges of the frame structure are preferably spaced from the body of the tank car. A pair of wood blocks are positioned within the frame structure in contact with the reinforcing pad, which blocks are secured to and caused to work in unison with the frame structure by stud members extending therethrough and through the side plates. Impact forces which are applied to the skid arrangement are directed by the stud members into the wood blocks and in turn are directed into the reinforcing pad and uniformly distributed over a relatively large area of the tank car body.

The skid arrangement is light in weight and provides uniform load distribution into the body of the tank car. Further, the skid arrangement utilizes a minimum amount of welding which permits the body of the tank car to flex with normal movement of the car, thereby reducing stress concentrations. The wood blocks provide amazing compressive strength for its weight and uniformly distribute the impact loads. Other advantages of the present invention will become apparent from the disclosure which hereinbelow follows.

The skid arrangement is disclosed in various attachment arrangements to tank cars having alternative reinforcing pad designs. Further, an extension arrangement is disclosed which cooperates with the skid arrangement.

BRIEF DESCRIPTION OF THE DRAWING

FIG. 1 is a side elevation view illustrating a railroad tank car adapted to receive the skid arrangement of the present invention.

FIG. 2 is a perspective view, partially broken away, illustrating the skid arrangement of the present invention in combination with an outlet valve.

FIG. 5 is an enlarged sectional view taken along line 5—5 in FIG. 4.

DESCRIPTION OF A PREFERRED EMBODIMENT

Figure 3:
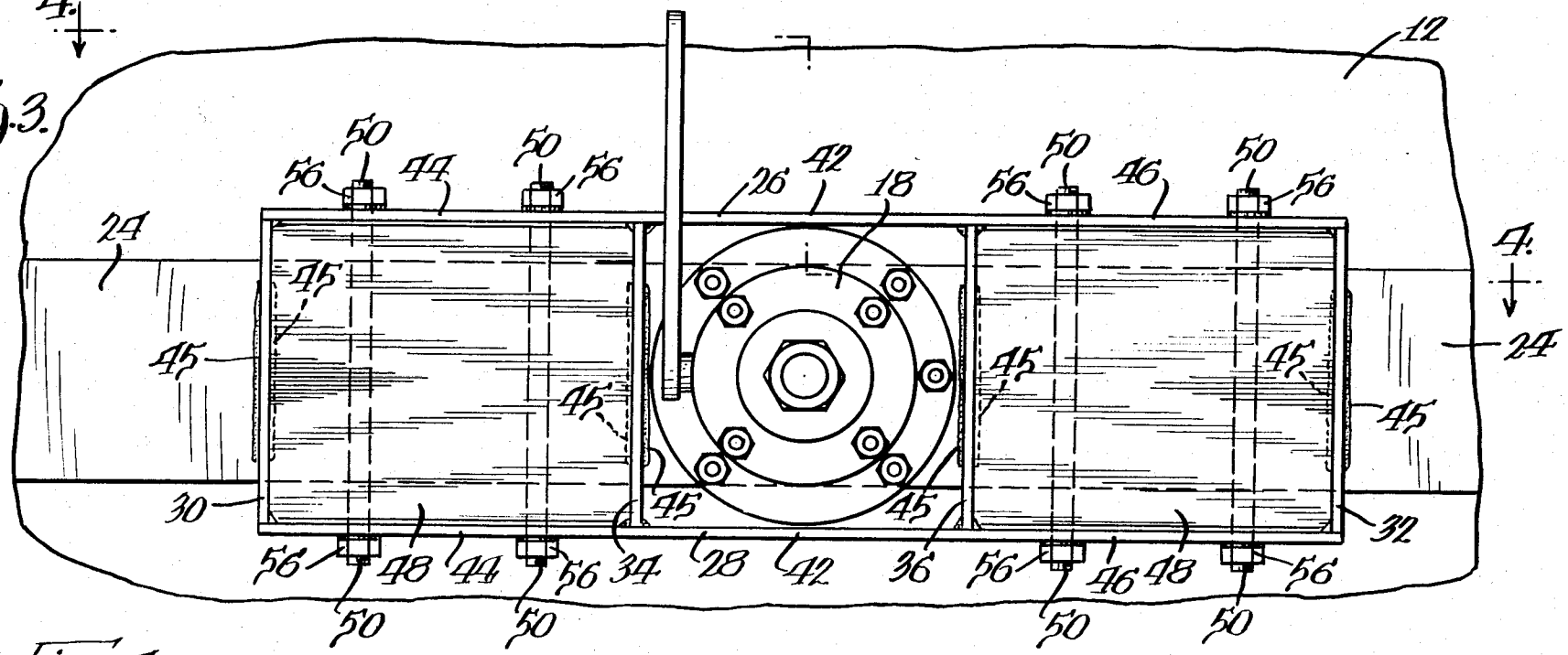
FIG. 3 is an enlarged bottom view of the skid arrangement as illustrated in FIG. 2.

Referring to FIG. 1, a railway tank car 10 is shown of a generally conventional construction and arrangement. More particularly, the railway tank car 10 includes an elongated cylindrical tank body 12 supported at its oppositely disposed ends by substantially identical wheel trucks 14 of generally conventional construction. Body 12 has a top manway 16, extending upwardly from an upper portion thereof, and an external bottom operable outlet valve 18, extending outwardly from the generally annular lower portion thereof. A skid arrangement, constructed in accordance with the present invention is indicated generally at 20.

Referring to FIGS. 2–5, the skid arrangement 20 is shown in cooperation with an external bottom operable ball valve 18, however, it is intended to be used in cooperation with other appurtenances. The specific structure of valve 18 is not part of the present invention and, accordingly, will only be described herein to the extent necessary for an understanding of the operation of the skid arrangement 20. An example of such a valve is Model UFRC 2222 TT manufactured by Union Tank Car Company.

Skid arrangement 20 includes a box-type skid frame structure 22, which is secured to a reinforcing pad 24. Reinforcing pad 24 is welded to the underside of the body 12 and longitudinally extends on either side of the valve 18 over substantially the entire length of the body 12. Frame structure 22 is defined by a pair of spaced apart, opposed, longitudinally extending side plates 26 and 28, a pair of transversely extending end plates 30 and 32, and a pair of transversely extending diaphragm plates 34 and 36. Side plates 26 and 28 have generally horizontal upper edges 38 and generally vertical end edges 40. The lower surfaces of the side plates 26 and 28 are defined by central generally horizontal edges 42 and a pair of inclined edges 44 and 46. Edges 44 and 46 incline upwardly and outwardly from the edges of the respective ends of edges 42 towards the edges 40. Edges 44 and 46 are preferably constructed with a 3:1 longitudinal to vertical slope to comply with the above described AAR and DOT Regulations. Accordingly, the vertical extent of the side plates 26 and 28 decreases as it extends longitudinally outward from the center portions thereof. The vertical extent of end plates 30 and 32 is generally equal to the length of edges 40. End plates 30 and 32 are respectively welded to the inner surfaces of side plates 26 and 28 adjacent the edges 40. Diaphragm plates 34 and 36 are respectively welded to the inner surfaces of side plates 26 and 28 at a location adjacent the ends of edges 42. The vertical extent of diaphragm plates 34 and 36 is generally equal to the distance between edges 38 and 42 of the side plates 26 and 28.

As best seen in FIG. 3, the upper edges of plates 30, 32, 34 and 36 are welded to the undersurface of reinforcing pad 24 along weld lines indicated at 45. As seen in FIG. 5, the pad 24 is contoured to conform with the curved bottom portion of the body 12, and, accordingly, the upper edges of plates 30, 32, 34 and 36 are contoured to conform with the contour of plate 24.

In accordance with a feature of the present invention, a lightweight filler means is positioned within the pair of open areas defined respectively between the plates 30 and 34 and the plates 32 and 36, in cooperation with the side plates 26 and 28. In accordance with a preferred form of the invention, the filler means are specifically shaped blocks 48 of a red oak wood material. These blocks are suitably treated to withstand the elements which are likely to be encountered during service. Blocks 48 are dimensioned to be received within the open areas and are formed with contoured upper surfaces 49 to conform with reinforcing pad 24 and inclined lower surfaces to conform with the inclined edges 44 and 46.

Blocks 48 are rigidly secured to frame structure 22 by stud members 50 which extend through transverse openings 52 formed in block 48 and corresponding openings formed in side plates 26 and 28. Stud members 50 have threaded ends which receive washers 54 and nuts 56 to secure the stud members to the side plates. In accordance with a preferred form of the invention, each block 48 has a pair of spaced apart stud members 50 extending therethrough, which are generally positioned midway along the vertical extent of the portion of the block. The stud members 50 serve the dual purpose of securing the blocks 48 in place and cause the blocks to work in unison with the frame structure. In order to snuggly position the blocks 48 in place within frame structure 22, shim members 58 are wedged between the side surfaces of the blocks and the corresponding side surfaces of the plates 26 and 28. Shim members 58 are provided with openings to permit the receipt of the stud members 50 therethrough.

Figure 4:
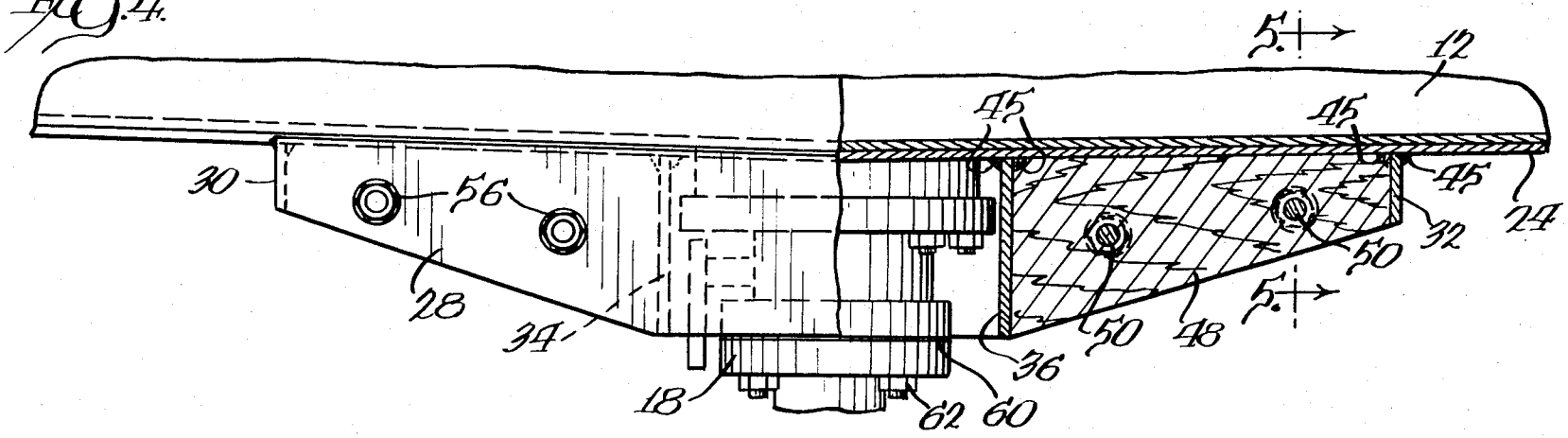
FIG. 4 is a sectional view, partially broken away, taken along the line 4—4 in FIG. 3.

As hereinabove mentioned, skid assembly 20 may be utilized to protect various appurtenances which extend from the bottom portion of the body 12. In the instance wherein the skid arrangement 20 is utilized to protect an external ball valve 18, having a shear plane designed therein, certain dimensional relationships are necessary to provide maximum safety. The valve 18, as shown in FIGS. 2 and 4, has a shear plane indicated at 60 and bolts 62. In order to fully protect the valve 18, the edge 42 of assembly 20 should extend to or below the shear plane 60. The skid arrangement 20 thereby protects the critical portions of the valve which are above the shear plane 60.

The skid arrangement 20 as hereinabove described provides a ramped skid to protect appurtenances which extend from the bottom of a railway tank car from impact and distributes the potentially heavy impact forces uniformly into the body or shell of the car. The impact forces which are applied to the skid arrangement 20 are directed by the stud members 50 into wood blocks 48 and then into the reinforcing plate 24 which uniformly distributes them into the tank body over a substantial length thereof. As alluded to hereinabove, the upper edges of the frame structure 22 are spaced from the body 12 which precludes the application of localized stresses into the body 12. Further, the fact that the frame structure 22 is welded to the reinforcing plate 24 in only four locations allows the body 12 to flex with the normal movement of the car, thus reducing stress concentrations.

As discussed above, if the skid arrangement 20 is impacted, the impact loads are directed into the massive tank body. If the tank has become unsaddled from its trucks, for example in derailment, and the tank is skidding along the ground, the skid tends to keep the tank moving and avoids impact loads. In the instance where the skid arrangement 20 is used in cooperation with a valve 18 having a shear plane 60, the lower portion of valve depending below surface 42 may be sheared off as the tank skids along, but the likelihood that the upper valve closure will become unseated is significantly reduced.

Figure 6:
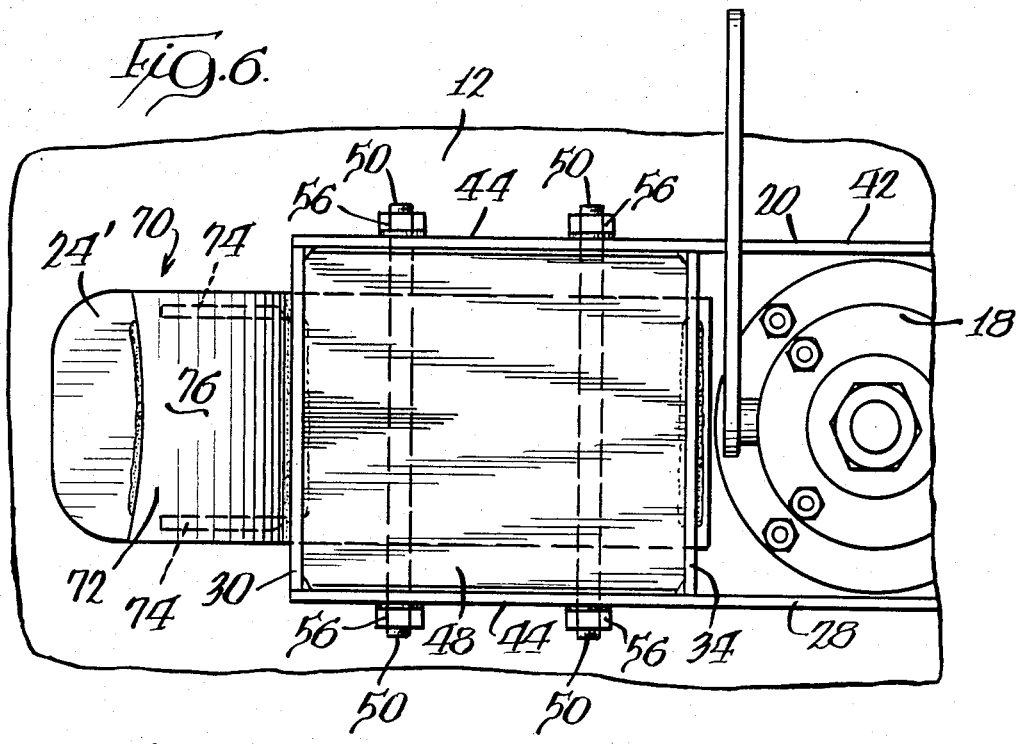
FIG. 6 is a bottom view of a portion of the skid arrangement of the present invention showing its attachment to a tank car which does not have a reinforcing pad and showing an extension assembly constructed in accordance with the invention.
Figure 7:
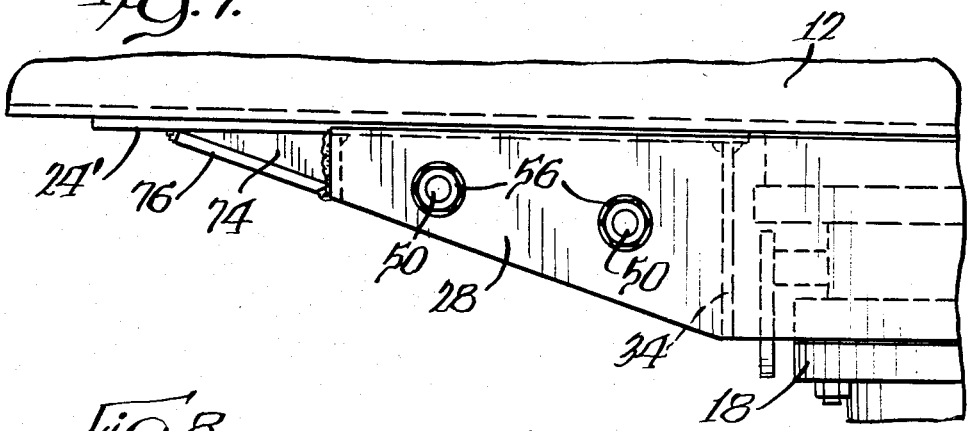
FIG. 7 is a side elevational view of the skid arrangement and extension assembly shown in FIG. 6.

Referring to FIGS. 6 and 7, an alternative attachment of the skid arrangement 20 is shown to a tank car 10 which does not already have a reinforcing pad 24. In such instance reinforcing pads 24′ are welded to the tank body 12 on either side of the valve 18 before the skid arrangement 20 is secured in place in the same manner as hereinabove discussed.

Referring to FIGS. 6 and 7, an extension assembly 70 is shown welded in place at the ends of the skid arrangement 20 to provide for protection of discontinuity depths down to about one inch. Extension assembly 70 includes an extension plate 72 and a pair of gusset plates 74. The gusset plates 74 are spaced apart and welded to the reinforcing pad 24′ and the corresponding end plate 30 or 32. The extension plate 72 is welded to the corresponding end plate 30 or 32 at its inner edge and the reinforcing pad 24′ at its outer edge. As best seen in FIG. 6, the outer ends of the outer edges of the extension plate 72 is not welded to the reinforcing pad. Further, the outer edge is formed to mate with and conform with the curvature of the reinforcing pad. It will be appreciated that the bottom surface 76 of the extension plate 72 serves as an extension of the bottom surface of the skid arrangement 20.

Figure 8:
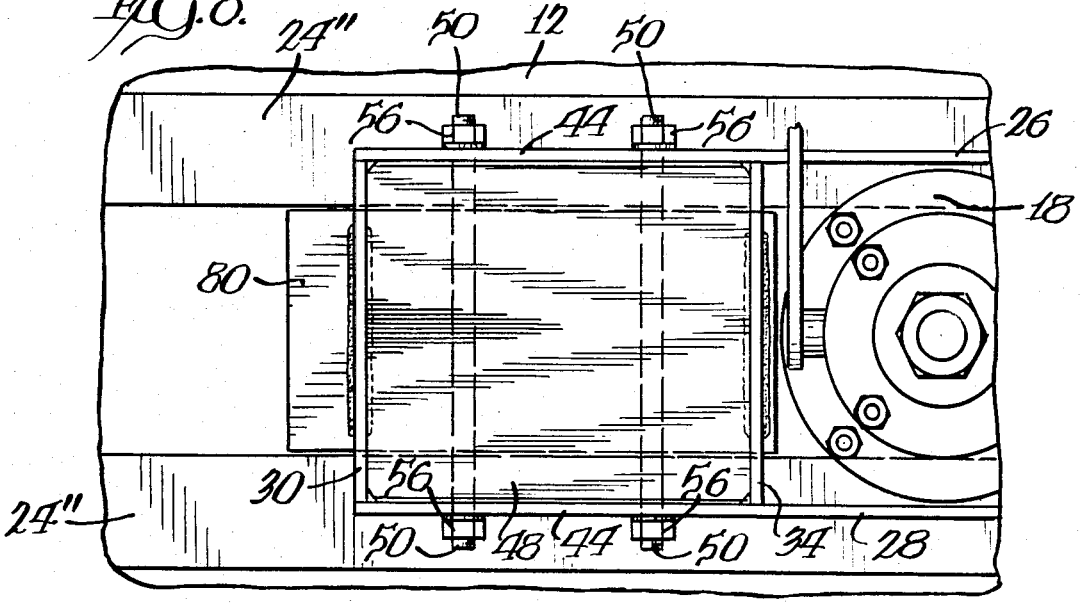
FIG. 8 is a bottom view of a portion of the skid arrangement of the present invention showing it attached to a tank car which has a double bottom reinforcing pad.

Referring to FIG. 8, an alternative attachment of the skid arrangement 20 is shown to a tank car 10 which is provided with a double bottom reinforcing pad 24″. In such instance, a pair of auxiliary reinforcing pads 80 are welded to plates 30 and 34 of the skid arrangement 20, on either side of the valve 18. The longitudinal edges of the auxiliary reinforcing pads 80 are preferably spaced a short distance from the reinforcing pads 24″. The construction of the skid arrangement 20 is substantially the same as hereinabove discussed. However, in this type of attachment thereof, the upper edges 38 of the side plates 26 and 28 are welded to the reinforcing pads 24″ at locations between the ends thereof and the corresponding diaphragm plates 34 or 36. Also, the end portions of the upper edges of the end plates 30 and 32 are preferably welded to the reinforcing pads 24".

While the present invention has been described with reference to particular embodiments, it is not intended to illustrate or describe herein all of the equivalent forms or ramifications thereof. Also, the words used are words of description rather than limitation, and various changes may be made without departing from the spirit or scope of the invention disclosed herein. It is intended that the appended claims cover all such changes as fall within the true spirit and scope of the invention.

What is claimed is:

1. In a railway tank car having an appurtenance extending downwardly from a generally annular body portion thereof, an improved skid arrangement; comprising:

(a) a reinforcing plate means secured to the underside of said body portion extending longitudinally on either side of said appurtenance;

(b) a skid frame structure suspended from said reinforcing plate means in a surrounding relationship to said appurtenance, said skid frame structure defined by a pair of longitudinally extending side plates having vertical extents which decrease as said side plates extend longitudinally outward from said skid frame structure so as to define a ramped lower surface and a pair of transversely extending end plates extending between and secured to the outer ends of said side plates so as to define a box-type structure surrounding said appurtenance, said side plates having upper edges transversely spaced outwardly of said reinforcing plate means, said end plates being rigidly secured to said reinforcing plate means such that said upper edges of said side plates and the upper edges of said end plates are spaced a short distance from said body portion; and (c) a lightweight filler means having a high compressive strength secured within the confines of said skid frame structure, said filler means having an upper surface which is positioned in contact with said reinforcing plate means so as to transmit impact forces applied to said skid arrangement uniformly to said reinforcing plate means and into said body portion.

2. The invention as defined in claim 1 wherein said filler means has a lower surface which decreases as it extends longitudinally outward from said appurtenance so as to conform with the ramped lower surface of said skid frame structure.

3. The invention as defined in claim 2 wherein said filler means has an upper surface which conforms with and contacts a lower surface of said reinforcing plate.

4. The invention as defined in claim 3 wherein said frame structure further includes a pair of transversely extending diaphragm plates extending between said side plates so as to sandwich said appurtenance therebetween and define a pair of open spaces in cooperation with said end plates, said filler means being positioned within said open spaces.

5. The invention as defined in claim 4 wherein said filler means includes a block of wood which is secured in each of said open spaces.

6. The invention as defined in claim 5 wherein each of said blocks of wood have at least one transversely extending opening formed therethrough, which opening is in alignment with a cooperating opening in each of said side plates, a stud member having threaded ends extends through said openings in said block of wood and side plates, and fastening means are received about said threaded ends of said stud member to secure stud member to said skid frame structure such that forces applied to said frame structure are transmitted through said stud member into said block of wood uniformly distributed through said reinforcing plate means into said body portion.

7. The invention as defined in claim 6 wherein each of said blocks of wood have a pair of said transversely extending openings longitudinally spaced and extending therethrough, each of said openings receiving one of said stud members therethrough and through corresponding openings in said side plates, each of said openings being generally centrally positioned in a vertical extent through a portion of each of said blocks of wood.

8. The invention as defined in claim 7 wherein shim members are positioned between the side surfaces of said blocks of wood and said side plates so as to snuggly position said blocks of wood in said open space, said shim members having openings for receipt of said stud members therethrough.

9. The invention as defined in claim 3 wherein said appurtenance is an external ball valve assembly.

10. The invention as defined in claim 9 wherein said ball valve assembly has a horizontal shear plane which is positioned at or above the lowermost extent of said side plates.

11. The invention as defined in claim 1 wherein extension assemblies are secured at the outer ends of said skid frame structure, said extension assemblies having bottom surfaces which serve as an extension of said ramped lower surface.

12. The invention as defined in claim 11 wherein each of said extension assemblies includes an extension plate defining said bottom surface and gusset plate means extending between said extension plate and said reinforcing plate.

13. In a railway tank car having an appurtenance extending downwardly from a generally annular body portion thereof, an improved skid arrangement; comprising:

(a) a pair of longitudinally extending reinforcing plates secured to the underside of said body portion transversely spaced one on either side of said appurtenance;

(b) a pair of auxiliary reinforcing plates secured to said body portion between said reinforcing plates one on either side of said appurtenance;

(c) a skid frame structure secured to said reinforcing plates in a surrounding relationship to said appurtenance, said skid frame structure defined by a pair of longitudinally extending side plates having vertical extents which decrease as said side plates extend longitudinally outward from said skid frame structure so as to define a ramped lower surface and a pair of transversely extending end plates extending between and secured to the outer ends of said side plates so as to define a box-type structure surrounding said appurtenance, said end plates being rigidly secured to said auxiliary reinforcing plates; and (d) a lightweight filler means having a high compressive strength secured within said skid frame structure, said filler means having an upper surface which is in contact with said reinforcing plates and said auxiliary reinforcing plates so as to transmit impact forces applied to said skid arrangement uniformly through said reinforcing plates and said auxiliary reinforcing plates into said body portion.

14. The invention as defined in claim 13 wherein said frame structure further includes a pair of transversely extending diaphragm plates extending between said side plates so as to sandwich said appurtenance therebetween and define a pair of open spaces in cooperation with said end plates, said filler means being positioned within said open spaces.

15. The invention as defined in claim 14 wherein said filler means includes a block of wood which is secured in each of said open spaces.

16. The invention as defined in claim 15 wherein each of said blocks of wood have at least one transversely extending opening formed therethrough, which opening is in alignment with a cooperating opening in each of said side plates, a stud member having threaded ends extends through said openings in said block of wood and side plates, and fastening means are received about said threaded ends of said stud member to secure stud member to said skid frame structure such that forces appplied to said frame structure are transmitted through said stud member into said block of wood uniformly distributed through said reinforcing plates and said auxiliary reinforcing plates into said body portion.

* * * * *